US012050070B2

(12) United States Patent
Kloepfer et al.

(10) Patent No.: US 12,050,070 B2
(45) Date of Patent: Jul. 30, 2024

(54) TECHNIQUES FOR INDICATING GUN STATE INFORMATION

(71) Applicant: Biofire Technologies Inc., Broomfield, CO (US)

(72) Inventors: Kai Thorin Kloepfer, Denver, CO (US); Bryan Edward Rogers, Aurora, CO (US); Benjamin William Dwyer, Golden, CO (US); Donna Kelley, Louisville, CO (US); Jack Hugo Thiesen, Firestone, CO (US); Christopher James Owens, Denver, CO (US)

(73) Assignee: Biofire Technologies Inc., Broomfield, CO (US)

( * ) Notice: Subject to any disclaimer, the term of this patent is extended or adjusted under 35 U.S.C. 154(b) by 0 days.

(21) Appl. No.: 18/309,214

(22) Filed: Apr. 28, 2023

(65) Prior Publication Data

US 2023/0314097 A1 Oct. 5, 2023

Related U.S. Application Data

(63) Continuation of application No. 17/211,760, filed on Mar. 24, 2021, now Pat. No. 11,674,767.

(51) Int. Cl.
*F41A 17/06* (2006.01)
*F41G 1/34* (2006.01)

(52) U.S. Cl.
CPC ..... *F41A 17/06* (2013.01); *F41G 1/345* (2013.01)

(58) Field of Classification Search
CPC ..... F41A 17/06; F41A 35/00; F41A 99/00; F41G 1/345
See application file for complete search history.

(56) References Cited

U.S. PATENT DOCUMENTS

| | | | | |
|---|---|---|---|---|
| 5,303,495 | A | 4/1994 | Harthcock | |
| 7,509,766 | B2 | 3/2009 | Vasquez | |
| 11,674,767 | B2 * | 6/2023 | Kloepfer | F41G 1/34 42/132 |
| 2015/0377572 | A1 | 12/2015 | Darragjati | |
| 2021/0180899 | A1 * | 6/2021 | Farrell | F41A 17/30 |
| 2021/0215446 | A1 | 7/2021 | Czarnecki et al. | |

* cited by examiner

*Primary Examiner* — J. Woodrow Eldred
(74) *Attorney, Agent, or Firm* — Perkins Coie LLP; Andrew T. Pettit

(57) ABSTRACT

The present disclosure provides techniques, systems, and devices that support indicating gun state information. One or more electronic components may be used to indicate the gun state information, and the electronic components may be coupled with a gun. The gun may identify a state of the gun based on a compute component including a data signal, and the compute component may be coupled with the gun. The gun may select a representation of the state of the gun, where the representation of the state of the gun is compatible with an electronic component coupled with the gun. The gun may indicate, at the electronic component and based on the compute component, the state of the gun with the representation of the state of the gun. Indicating the state of the gun may include displaying an icon, illuminating the electronic component with a color, or pulsating the electronic component.

22 Claims, 12 Drawing Sheets

TECHNIQUES FOR INDICATING GUN STATE INFORMATION

CROSS-REFERENCE TO RELATED APPLICATIONS

This application is a continuation of U.S. application Ser. No. 17/211,760, titled "Techniques for Indication Gun State Information" and filed Mar. 24, 2021, which is incorporated by reference herein in its entirety.

FIELD OF TECHNOLOGY

The teachings disclosed herein generally relate to guns, and more specifically to indicating gun state information.

BACKGROUND

Gun technology includes multiple types of guns, such as handguns, shotguns, rifles, semi-automatic guns, and automatic guns. Some guns may use a purely mechanical component for indicating gun state information. However, using a mechanical component to indicate gun state information may restrict the type of gun state information that can be indicated to a user. Current gun technology fails to adequately indicate gun state information.

SUMMARY

The techniques, methods, systems, devices, and apparatuses described herein support indicating gun state information. The state information may include a ready state, a locked state, an unlocked state, an error state, a charging state, a power state, or other information, as described herein. The gun may be an example of a gun or firearm, such as a handgun, a shotgun, a rifle, a semi-automatic gun, or an automatic gun. Unless stated otherwise, the terms gun and firearm may be used interchangeably herein. Generally, the described techniques provide for indicating gun state information, particularly in the context of electronic or electro-mechanical guns. The described techniques also improve gun safety and design.

For example, a gun may identify, at a compute component including a data signal, a state of the gun. The compute component may be coupled with the gun, and the compute component may include any combination of software, memory, communications channels, processors, and hardware. The gun may select a representation of the state of the gun, where the representation of the state of the gun is compatible with an electronic component coupled with the gun. The gun may indicate, at the electronic component and based on the compute component, the state of the gun with the representation of the state of the gun. Indicating the state of the gun may include illuminating the electronic component with a color corresponding to the representation of the state of the gun or displaying an icon with the electronic component, the icon corresponding to the representation of the state of the gun.

DETAILED DESCRIPTION

Figure 1:
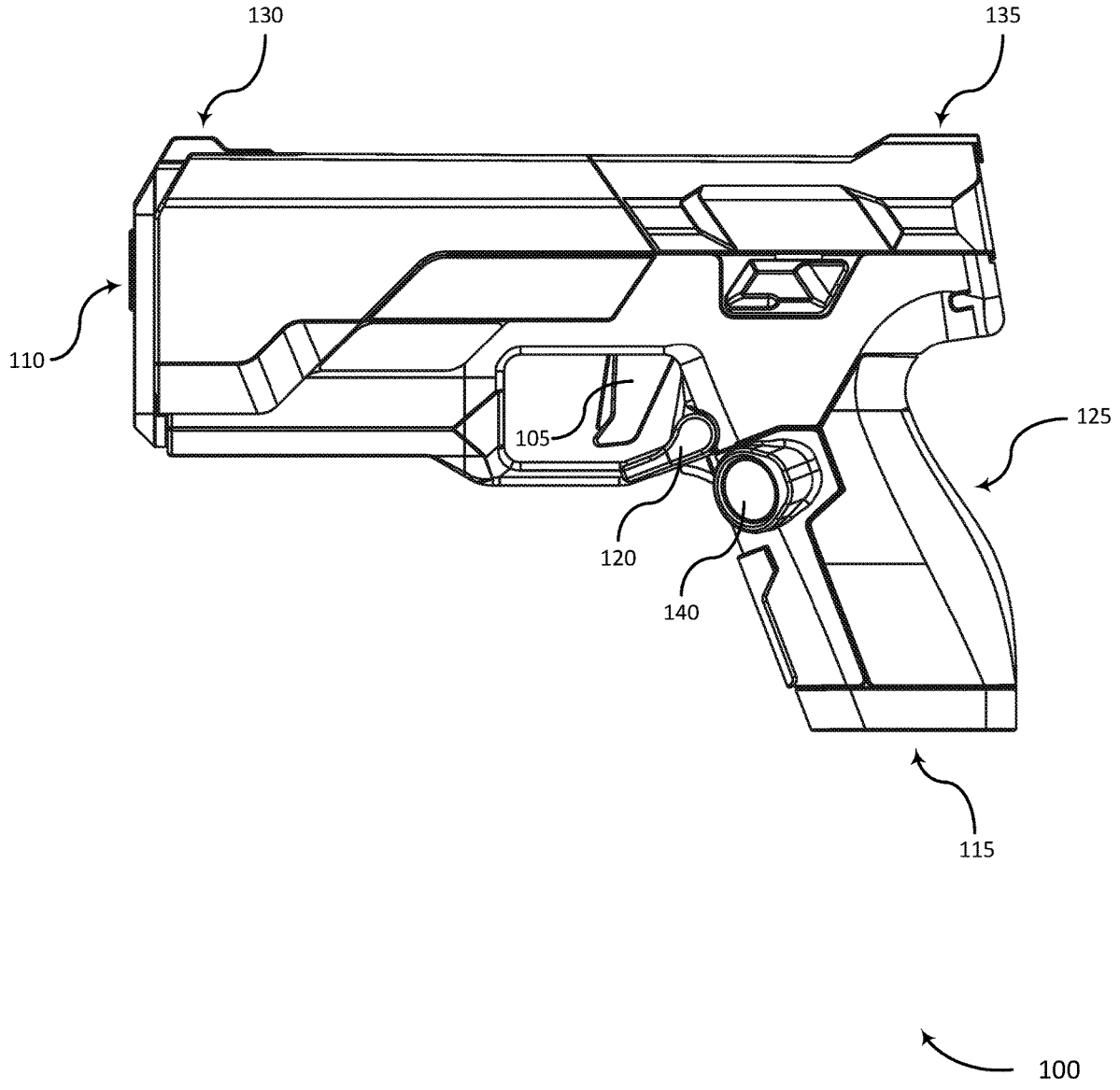
FIG. 1 illustrates an example of a gun that supports indicating gun state information in accordance with aspects of the present disclosure.

The embodiments described herein include methods, systems, and apparatuses for indicating gun state information with an electronic component. Some conventional guns may use a mechanical switch, such as a safety switch, to indicate information about the state of the gun. A mechanical switch is limited with regards to the type of state information that can be indicated, and some guns may not include a mechanical switch that indicates state information. For example, a mechanical safety switch may indicate gun state information by displaying a red color when the gun is in a first state (e.g., the safety is disengaged), and the mechanical safety switch may indicate gun state information by not displaying the red color when the gun is in a second state (e.g., the safety is engaged). Some mechanical switches may be capable of indicating two gun states (e.g., a safety engaged state and a safety not engaged state), and some guns may not include mechanical switches capable of indicating gun state information. As such, conventional guns may fail to indicate gun state information, particularly in the context of electronic, or partially electronic (e.g., electro-mechanical), guns.

Various aspects of the present disclosure provide systems for indicating gun state information in the context of electronic, or partially electronic, guns. For example, a gun or component thereof may identify a state of the gun and utilize a representation of the state of the gun at an electronic component to indicate the state of the gun. The electronic component may be coupled with the gun and include a component such as a light pipe, a display panel, an electronically actuated switch, or the like. For example, a light pipe may be illuminated with a color and/or pulsate in a patterned manner to indicate the state of the gun, the display panel may present an icon or other representation of the state of the gun, or the electronically actuated switch may be positioned in a manner that indicates the state of the gun.

One or more electronic components may be used to indicate gun state information in addition to, or instead of, a mechanical safety switch.

Such systems support indicating gun state information with an electronic component that is coupled with the gun. The electronic component may be incorporated in a sight (e.g., a front aiming sight and/or a rear aiming sight) of the gun, or the electronic component may be incorporated in a display panel (e.g., a display panel on the rear or side of the gun). For example, the electronic component may be incorporated in the front sight as a light emitting source, such as a light pipe, a light-emitting diode (LED), a compact fluorescent lamp (CFL), an incandescent light bulb, or the like, or the electronic component may be incorporated in the display panel, which may include a liquid-crystal display (LCD), an organic light-emitting diode (OLED) display, an active-matrix organic light-emitting diode (AMOLED) display, or the like. The electronic component may illuminate with a color and/or pulsate in a patterned manner to indicate a gun state, such as ready state, a locked state, an unlocked state, a charging state, a power state, or an error state. The display panel may present one or more flashing icons to indicate and draw attention to the gun state. Using an electronic component to indicate gun state information allows the gun to indicate many types of gun state to users, thereby proving users with improved insight into the state and functionality of the gun.

Aspects of the disclosure are initially described in the context of guns. Aspects of the present disclosure are further illustrated by and described with reference to a vertical view of a gun, a rear view of a gun, apparatus diagrams, and system diagrams that relate to indicating gun state information.

FIG. 1 illustrates an example of a gun 100 that supports indicating gun state information in accordance with aspects of the present disclosure. The gun 100 may include a trigger 105, a barrel 110, a magazine 115, and a magazine release 120. The components and techniques described with reference to the gun 100 may be applied to pistols, rifles, shotguns, or vehicle mounted weapons. The gun 100 may utilize a striker and/or a hammer in the firing system, and the gun 100 may support the semi-automatic firing of projectiles, the automatic firing of projectiles, or both.

The gun 100 may include one or more safeties, which may reduce the likelihood of an unintended discharge. The gun 100 may include one or more mechanical safeties, such as a trigger safety and a firing pin safety. The trigger safety may be incorporated in the trigger 105 to prevent the trigger 105 from moving in response to lateral forces placed on the trigger 105. The firing pin safety may block the displacement path of the firing pin until the trigger 105 is pulled. The gun 100 may include electronic safety components, such as an electronically actuated drop safety. In some cases, the gun 100 may include both mechanical and electronic safeties to decrease the potential for unintended discharges and increase gun safety.

The gun 100 may include one or more electronic sensors, such as a user presence sensor 125 and a biometric sensor 140. In some cases, the gun 100 may include multiple user presence sensors 125. For example, the gun 100 may include a time of flight (TOF) sensor, a force sensor, a resistive sensor, or a mechanical switch. The gun 100 may include one or more biometric sensor 140. For example, the gun 100 may include a fingerprint scanner and a camera. The fingerprint scanner may be used to verify a user's fingerprint and the camera may be used to capture an image of the user, which may be used to perform facial recognition of the user. Including multiple biometric sensors in the gun 100 may support a robust authentication procedure that functions in the event of sensor failure, thereby improving gun reliability.

The gun 100 may support various types of gun sights. In some examples, the gun 100 may include "iron" sights, which may improve aim without the use of optics. The gun 100 may include telescopic sights, reflex sights, or laser sights. In some cases, the front sight 130 and/or the rear sight 135 may be used to indicate gun state information. For example, the front sight 130 may include an LED that illuminates with different colors to indicate different gun states.

The gun 100 may fire projectiles that are considered lethal (e.g., deadly force) or less-lethal (e.g., non-lethal force). For example, the gun 100 may fire projectiles containing lead, brass, copper, zinc, steel, plastic, rubber nylon, or a combination thereof. In some cases, the gun 100 may fire lethal bullets containing lead, while in some other cases the gun 100 may fire less-lethal bullets containing rubber. The techniques described herein may be used in the context of a device that fires prongs which carry electric current, such as a taser.

The gun 100 may identify, based on a compute component including a data signal, a state of the gun 100. The compute component may be coupled with the gun 100, and the compute component may receive a data signal from a sensor (e.g., a user presence sensor, a charge sensor, a trigger sensor, etc.), or the compute component may store the data signal in memory (e.g., volatile memory or non-volatile memory). The gun 100 may select a representation of the state of the gun 100, where the representation of the state of the gun 100 is compatible with an electronic component coupled with the gun 100. The gun 100 may indicate, at the electronic component and based on the compute component, the state of the gun 100 with the representation of the state of the gun 100. Indicating the state of the gun 100 may include illuminating the electronic component with a color corresponding to the representation of the state of the gun 100, displaying an icon with the electronic component, the icon corresponding to the representation of the state of the gun 100.

Figure 2:
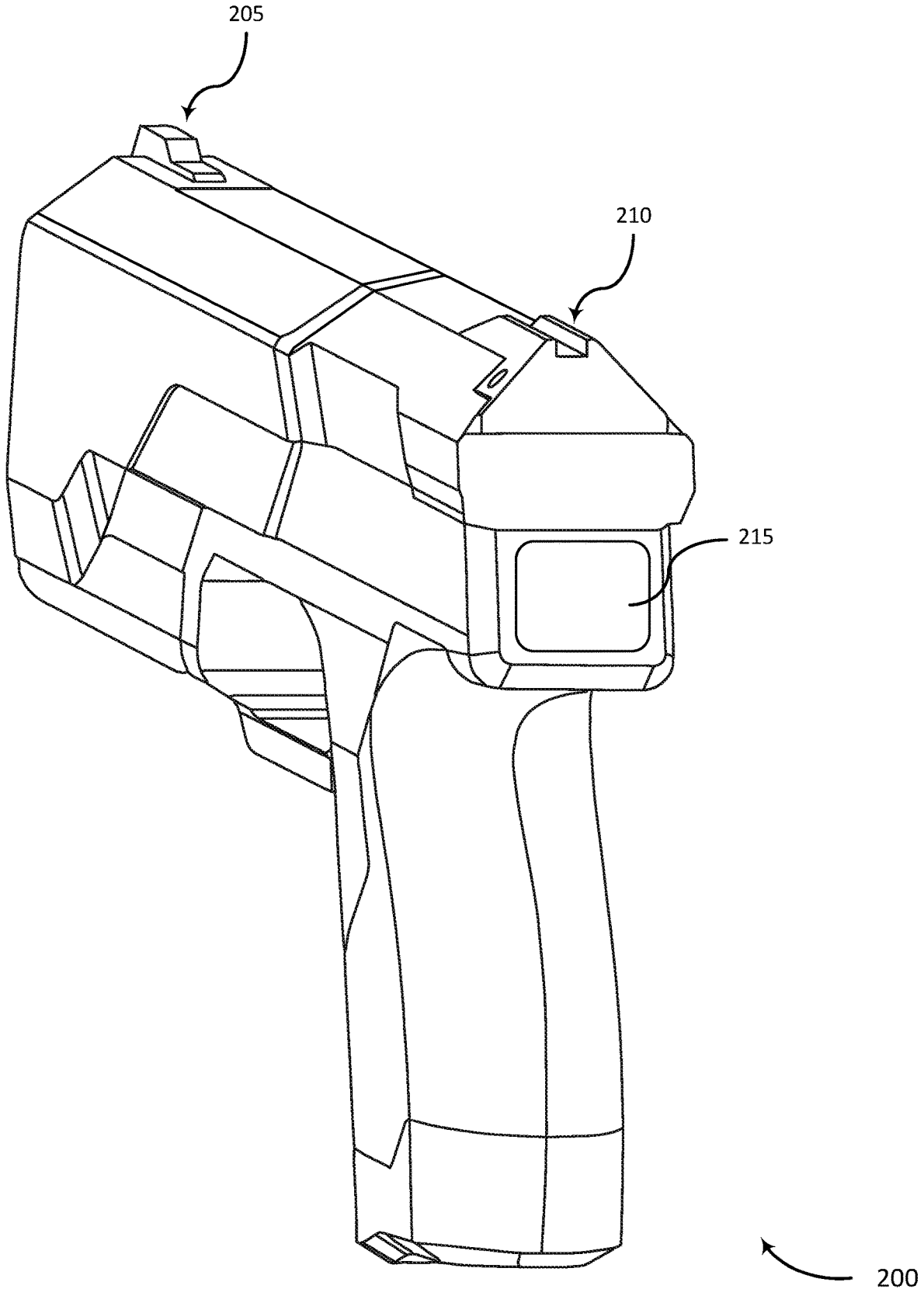
FIG. 2 illustrates an example of a gun that supports indicating gun state information in accordance with aspects of the present disclosure.

FIG. 2 illustrates an example of a gun 200 that supports indicating gun state information in accordance with aspects of the present disclosure. The gun 200 illustrates examples of state indication techniques for indicating gun state information. The gun 200 illustrates several electronic components, such as a front sight 205, a rear sight 210, and a display panel 215. The gun 200 may include any number of these electronic components, as well as any number of additional electronic components not shown in FIG. 2. For example, the gun 200 may include compute components, such as integrated circuits, circuit boards, communications channels, input/output (I/O) components, peripheral devices, or any combination thereof. The gun 200 may also include compute components such as an operating system, drivers, middleware, libraries, applications, or other software. The front sight 205, rear sight 210, display panel 215, or any combination thereof, may be used to indicate gun state information.

A compute component associated with the gun 200 may identify a state of the gun and select a representation of the state of the gun, and the representation of the state of the gun may be selected based on the representation being compatible with an electronic component, such as the front sight 205, the rear sight 210, or the display panel 215. For example, the front sight 205 may include an LED, and the compute component (e.g., a processor, a software system, etc.) may select a representation of the state of the gun that is compatible with the LED, such as a color and/or a pulse pattern. In some cases, the rear sight 210 may also include an electronic component for indicating state information, while in some other cases, the rear sight may not indicate state information.

The gun 200 may include the display panel 215, and the display panel 215 may support indicating gun state information. For example, the compute component may identify a state of the gun and select a representation of the state of the gun that is compatible with the display panel 215. The display panel 215 may support icons, images, stencils, or the like for representing and indicating gun state information. In some cases, the display panel 215 may indicate gun state information by illuminating a number of LEDs. For example, the display panel 215 may include a number (e.g., "N") of LEDs arranged in a circular, arced or linear fashion, and to indicate a power state of the gun 200, one or more of the LEDs may be illuminates (e.g., illuminating 1/X LEDs indicates a power state of 1/X, illuminating 2/X LEDs indicates a power state of 2/X, illuminating X/X LEDs indicates a power state of X/X or a full power state, etc.).

The gun 200 may support configuring one or more electronic components for indicating state information. For example, a user may configure the gun 200 to use an electronic component, such as the front sight 205, the rear sight 210, or the display panel 215, for indicating state information. The user may enable a first component (e.g., the front sight 205) for indicating state information and disable a second component (e.g., the display panel 215) for indicating state information. The user may additionally or alternatively configure the manner in which an electronic component indicates state information. In some examples, the user may configure the gun 200 to use a color, a pulse pattern, or an icon to indicate a state. For example, the user may configure the gun 200 to indicate an unlocked state by emitting a red color from the front sight 205, a locked state by not emitting a color from the front sight 205, a charging state by pulsating the front sight 205 with a blue color, and an error state by pulsating a purple color with both the front sight 205 and the rear sight 210. The user may also configure the gun 200 to display error information and/or potential error resolution messages on the display panel 215. Using an electronic component for indicating state information supports representing multiple types of state to users in an efficient and intuitive manner.

An electronic component may be used to indicate gun states (e.g., a ready state, a locked state, an unlocked state, etc.) in an efficient and intuitive manner. The electronic component may also be used to represent error information, such as the type of error, the location of the error, the severity of the error, or resolutions for the error. The electronic component may also be used to represent a power state (e.g., a charging state or a battery level) and a gun status state, such as whether a magazine is present or whether a round (e.g., cartridge) is chambered. Indicating such state information may improve gun safety and reliability, as a user can quickly identify the state of the gun upon visual inspection.

Figure 3:
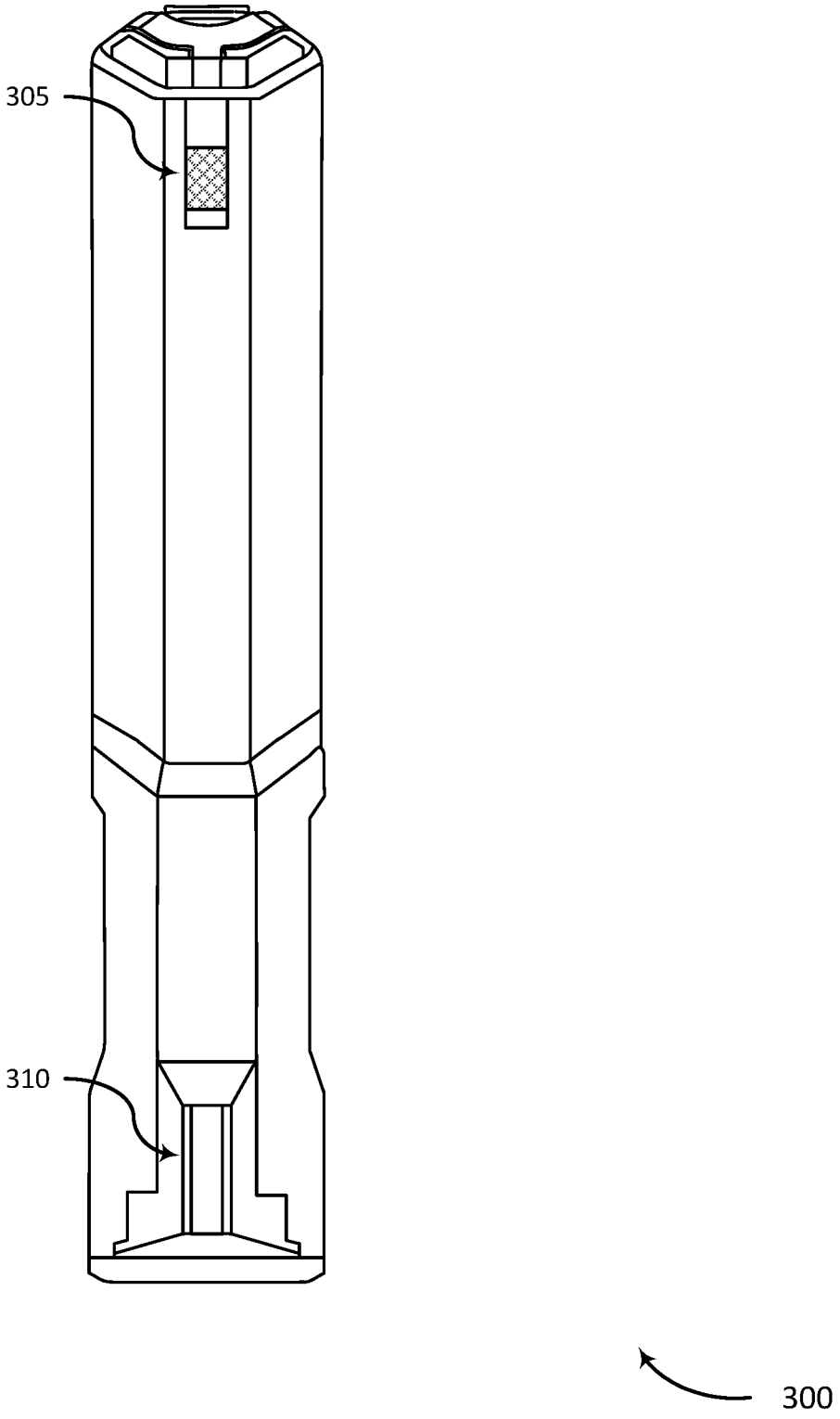
FIG. 3 illustrates an example of a top view of a gun that supports indicating gun state information in accordance with aspects of the present disclosure.

FIG. 3 illustrates an example of a vertical view of a gun 300 that supports indicating gun state information in accordance with aspects of the present disclosure. The vertical view of the gun 300 may be an example of the gun 200 as described with reference to FIG. 2. The vertical view of the gun 300 illustrates how gun state information may be indicated to a user in an efficient and non-distracting manner.

The front sight 305 and/or the rear sight 310 may be examples of electronic components that support indicating gun state information, and a user operating the gun may use the front sight 305 and/or the rear sight 310 to verify the state of the gun without needing to alter their field of vision. For example, the user may draw and aim the gun at an attacker, and the user may verify the state of the gun by identifying the color (e.g., red) of the front sight 305. As such, the user does not need to look away from the attacker to verify the state of the gun, thereby allowing the user to verify the state of the gun while maintaining focus on the threat.

Figure 4:
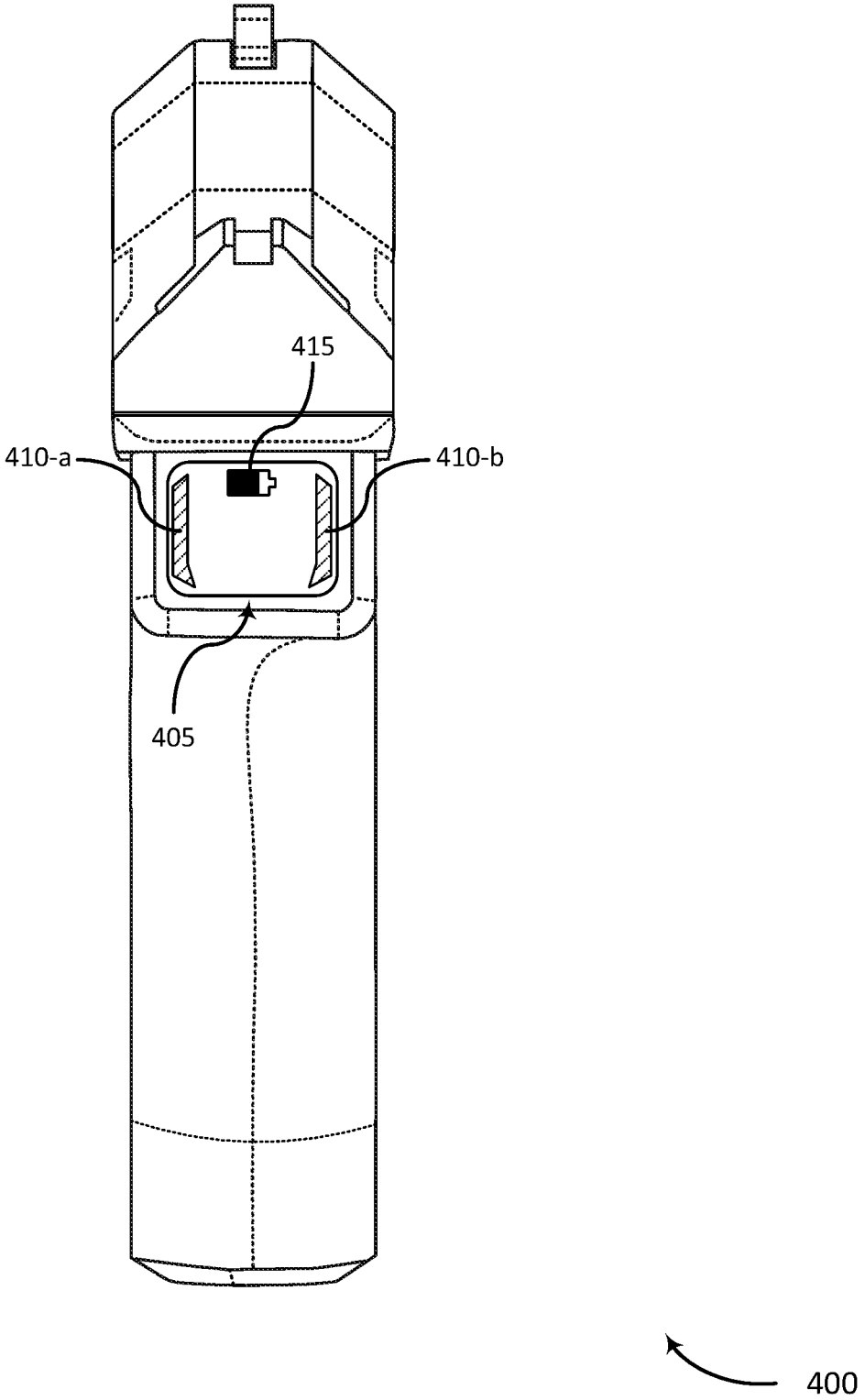
FIG. 4 illustrates an example of a rear view of a gun that supports indicating gun state information in accordance with aspects of the present disclosure.

FIG. 4 illustrates an example of a rear view of a gun 400 that supports indicating gun state information in accordance with aspects of the present disclosure. The rear view of the gun 400 may be an example of the gun 200 as described with reference to FIG. 2. The rear view of the gun 400 supports indicating detailed gun state information to a user.

The display panel 405 may be an example of an electronic component that supports indicating gun state information. The display panel 405 may display gun state information to a user and/or be used for user input. For example, the display panel 405 may be touch sensitive and support a user in configuring how states are indicated by the gun. The display panel 405 may present icons or templates to represent gun state information. The display panel 405 may present the battery icon 415 to indicate the amount of remaining battery life. The display panel 405 may present one or more state indication icons (e.g., state indication icon 410-*a* and/or state indication icon 410-*b*) to indicate the state of the gun. In some cases, state indication icon 410-*a* and state indication icon 410-*b* may be the same color (e.g., red) to indicate the state of the gun (e.g., unlocked). In some other cases, state indication icon 410-*a* and state indication icon 410-*b* may illuminate in an alternating fashion. For example, to indicate an error state, state indication icon 410-*a* and state indication icon 410-*b* may pulsate with a color (e.g., purple, blue, etc.) in a complementary fashion (e.g., state indication icon 410-*a* illuminates with purple as state indication icon 410-*b* is unilluminated, and state indication icon 410-*b* illuminates with purple as state indication icon 410-*a* is unilluminated) to indicate an error state.

Figure 5:
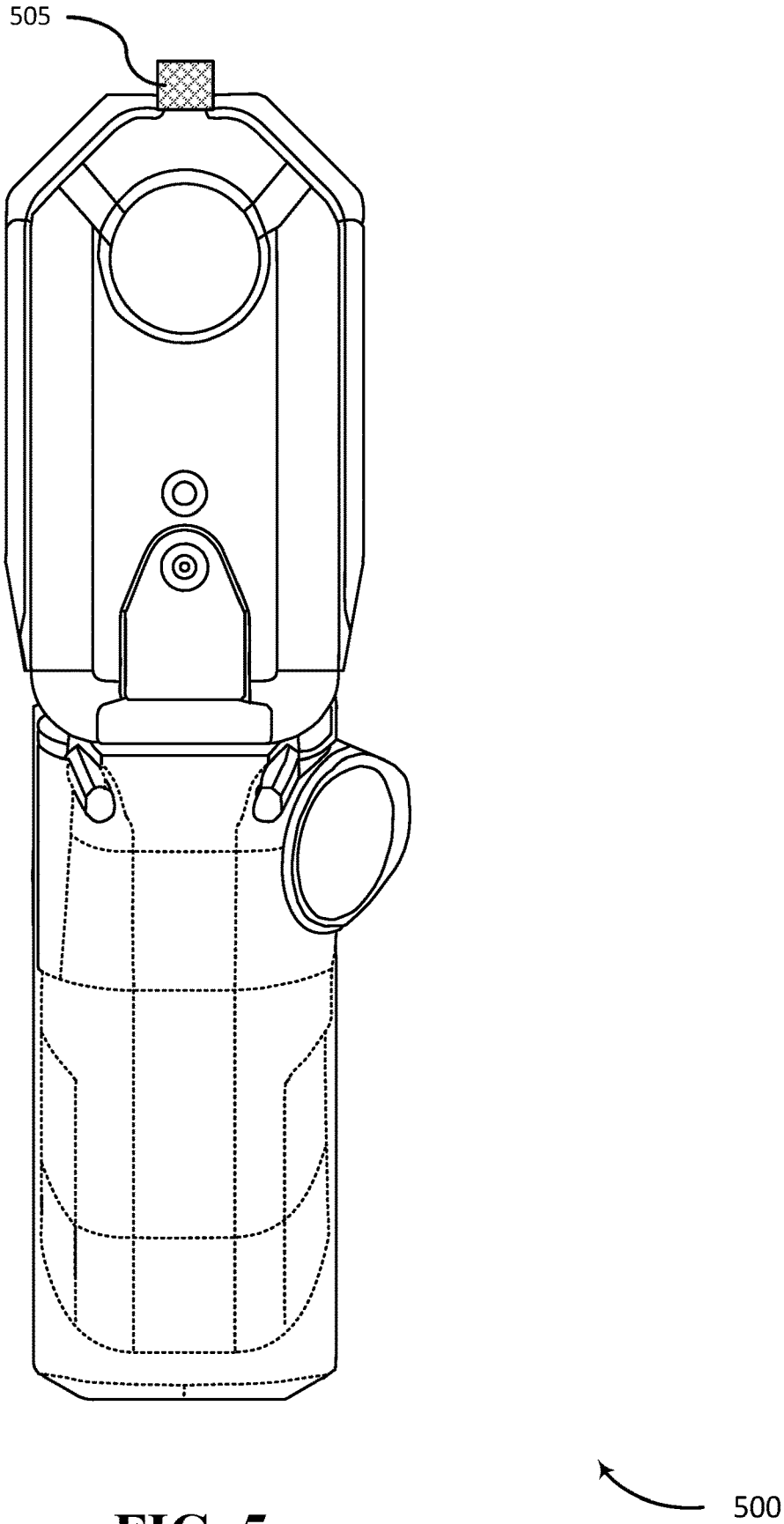
FIG. 5 illustrates an example of a front view of a gun that supports indicating gun state information in accordance with aspects of the present disclosure.

FIG. 5 illustrates an example of a front view of a gun 500 that supports indicating gun state information in accordance with aspects of the present disclosure. The front view of the gun 500 may be an example of the gun 200 as described with reference to FIG. 2. The front view of the gun 500 supports indicating detailed gun state information to a user.

The front view of the gun 500 includes a front sight 505, which may be an example or component of an electronic component that indicates gun state information. For example, the front sight 505 may include an LED that emits light pulses and/or colors to indicate gun state information.

Figure 6:
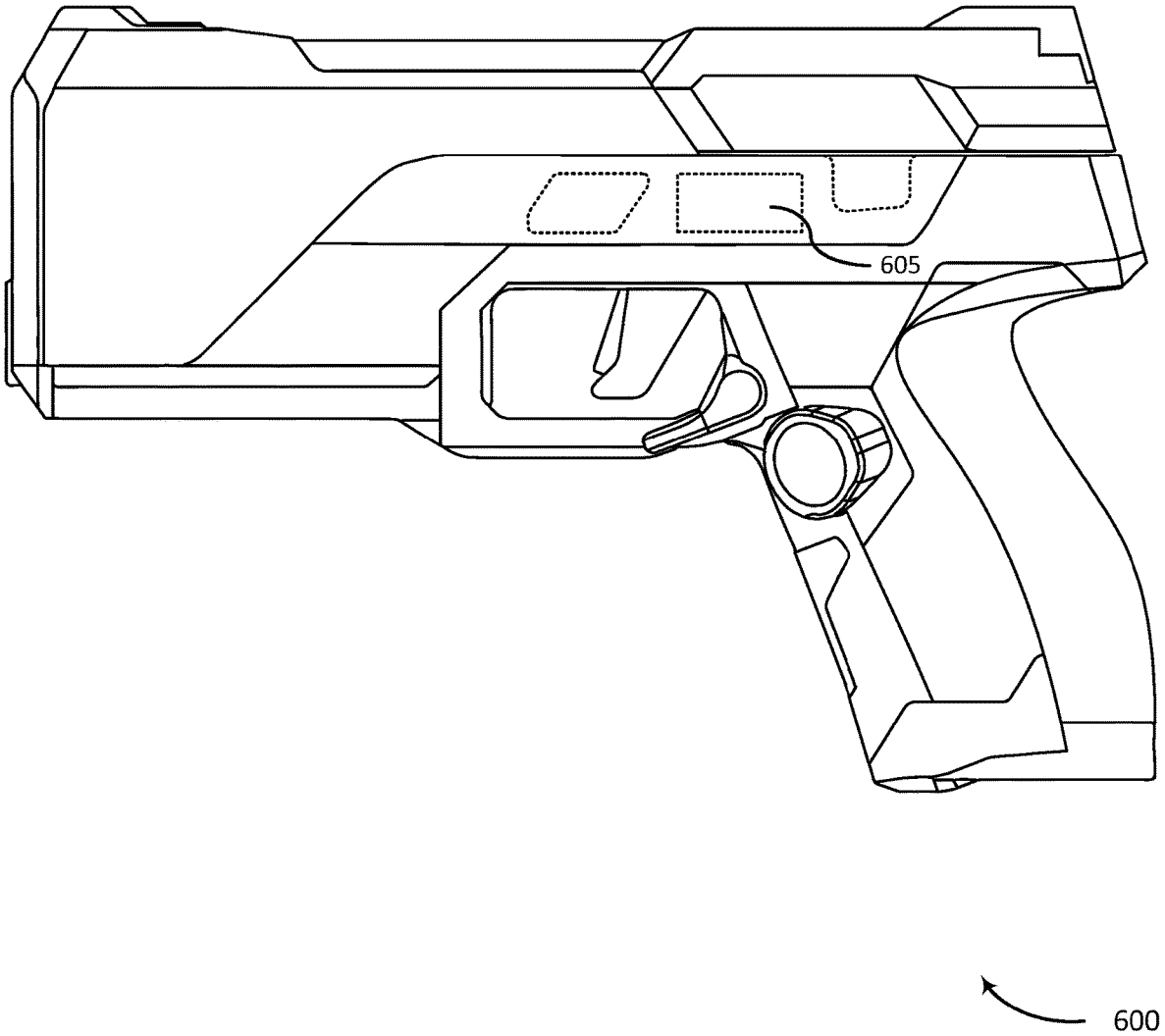
FIG. 6 illustrates an example of a left view of a gun that supports indicating gun state information in accordance with aspects of the present disclosure.

FIG. 6 illustrates an example of a left view of a gun 600 that supports indicating gun state information in accordance with aspects of the present disclosure. The view of the gun 600 may be an example of the gun 200 as described with reference to FIG. 2. The left view of the gun 600 supports indicating detailed gun state information to a user.

The left view of the gun 600 includes a display panel 605, which may be an example or component of an electronic component as described herein. The display panel 605 may indicate gun state information with icons and/or LEDs. The display panel 605 may also indicate gun state information, such as error codes. In some cases, the display panel 605 may indicate gun state information such as the number of bullets present in the gun.

Figure 7:
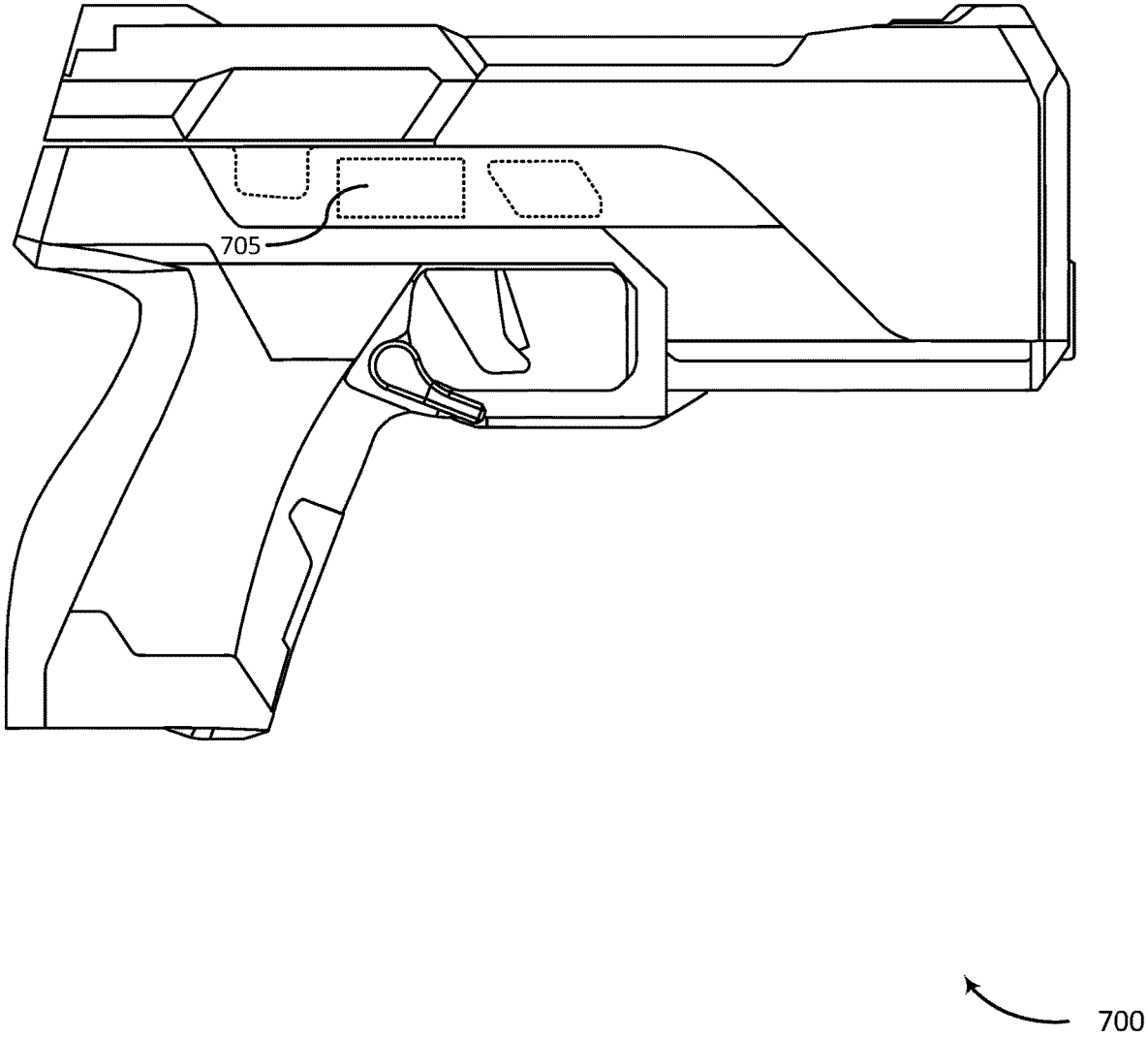
FIG. 7 illustrates an example of a right view of a gun that supports indicating gun state information in accordance with aspects of the present disclosure.

FIG. 7 illustrates an example of a right view of a gun 700 that supports indicating gun state information in accordance with aspects of the present disclosure. The right view of the gun 700 may be an example of the gun 200 as described with reference to FIG. 2. The right view of the gun 700 supports indicating detailed gun state information to a user.

The right view of the gun 700 includes a display panel 705, which may be an example or component of an electronic component as described herein. The display panel 705 may indicate gun state information with icons and/or LEDs. The display panel 705 may also indicate gun state information, such as error codes. In some cases, the display panel 705 may indicate gun state information such as the number of bullets present in the gun.

Figure 8:
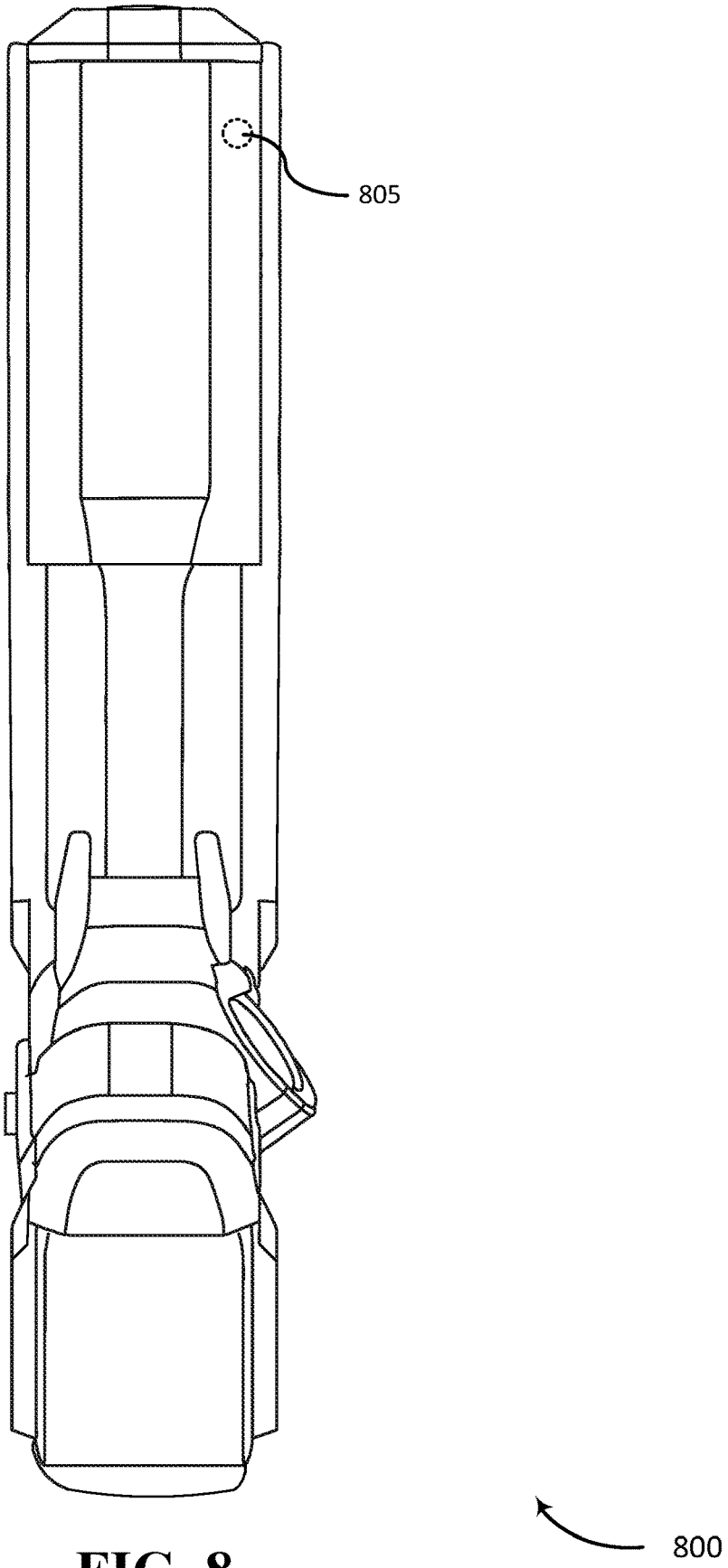
FIG. 8 illustrates an example of a bottom view of a gun that supports indicating gun state information in accordance with aspects of the present disclosure.

FIG. 8 illustrates an example of a bottom view of a gun 800 that supports indicating gun state information in accordance with aspects of the present disclosure. The bottom view of the gun 800 may be an example of the gun 200 as described with reference to FIG. 2. The bottom rear view of the gun 800 supports indicating detailed gun state information to a user.

The bottom view of the gun 800 includes an electronic component 805 that may be used to indicate gun state information. For example, the electronic component 805 may include a speaker that emits audible noise to indicate gun state information. In some cases, the electronic component 805 may include an LED that emits a color to indicate gun state information, such as a battery power level.

Figure 9:
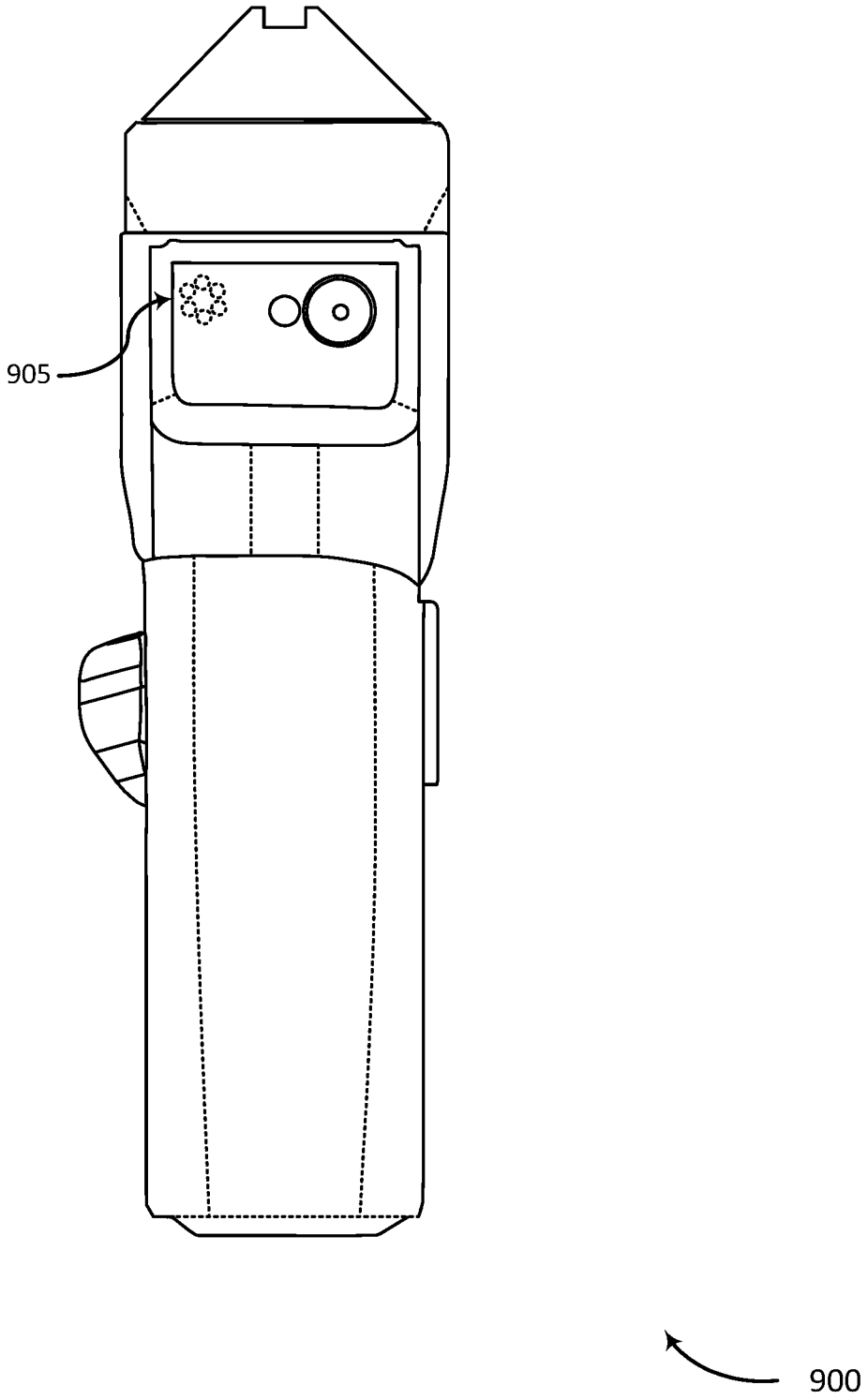
FIG. 9 illustrates an example of a rear view of a gun that supports indicating gun state information in accordance with aspects of the present disclosure.

FIG. 9 illustrates an example of a rear view of a gun 900 that supports indicating gun state information in accordance with aspects of the present disclosure. The rear view of the gun 900 may be an example of the gun 200 as described with reference to FIG. 2. The rear view of the gun 900 supports indicating detailed gun state information to a user.

The rear view of the gun 900 includes an electronic component 905 for indicating gun state information. The electronic component 905 may include a group of LEDs that emit colors to indicate un state information. For example, each LED of the group of LEDs may emit the same color to indicate a state of the gun. In some cases, the LEDs may flash to indicate guns state information. For example, the LEDs may light up in a circular pattern to indicate a charging state.

Figure 10:
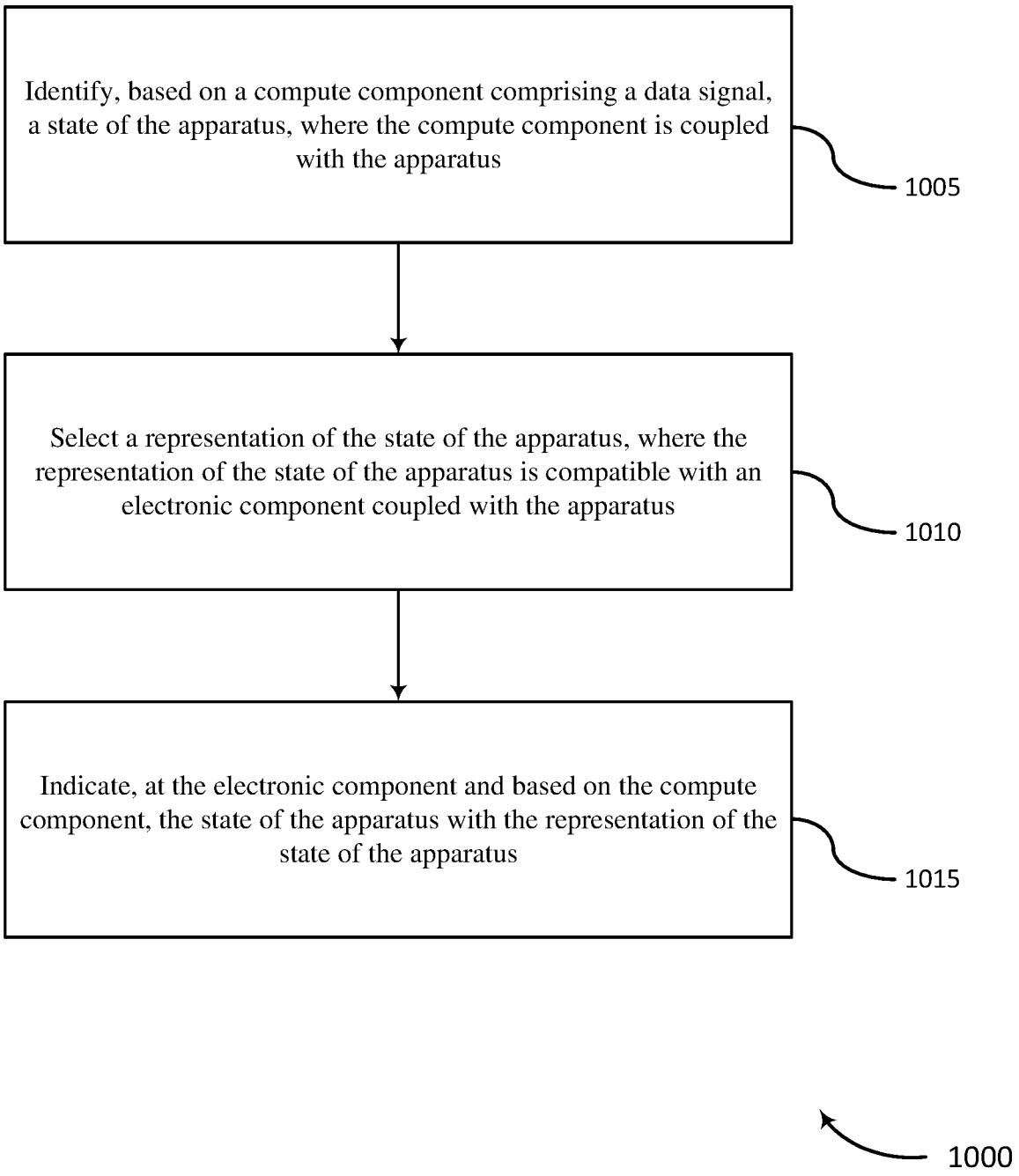
FIG. 10 illustrates an example of a flowchart that supports indicating gun state information in accordance with aspects of the present disclosure.

FIG. 10 illustrates an example of flowchart 1000 that supports indicating gun state information in accordance with aspects of the present disclosure. The flowchart 1000 supports indicating detailed gun state information to a user. The operations of flowchart 1000 may be implemented by a gun or its components as described herein. Alternative examples of the following may be implemented where some steps are performed in a different order than described or are not performed at all. The steps may include additional features not mentioned below, and further steps may be added.

At 1005, a gun, weapon, device (e.g., an apparatus) may identify, based on a compute component including a data signal, a state of the apparatus, where the compute component is coupled with the apparatus. For example, the compute component may include an IC, a microchip, a PCB, or the like, and the compute component may be potted or otherwise embedded in the apparatus. The compute component may use one or more buses to communicate with other compute components, sensors, peripheral devices, or accessories.

At 1010, the apparatus may select a representation of the state of the apparatus, where the representation of the state of the apparatus is compatible with an electronic component coupled with the apparatus. For example, the apparatus may identify a configuration for indicating state information (e.g., retrieve configuration data stored in memory), select an electronic component for indicating state information, and select a representation of the state of the apparatus based on the configuration and the electronic component. In some cases, the representation of the state of the apparatus may be selected based on user data. For example, the apparatus may retrieve the configuration data for the user that has most recently been authenticated and select the representation of the state of the apparatus based on the configuration data associated with the user.

At 1015, the apparatus may indicate, at the electronic component and based on the compute component, the state of the apparatus with the representation of the state of the apparatus. For example, the compute component may transmit a signal to the electronic component, and the electronic component may indicate the state of the apparatus with the representation of the state of the apparatus based on receiving the signal. In some cases, the representation of the state of the apparatus correspond to an LED color and/or pulse pattern, and the electronic component may indicate the state of the apparatus by emitting the color and/or pulsing according to the pattern. In some cases, the representation of the state of the apparatus may correspond to a tactile pulse, and a haptic motor (e.g., located in the grip) may pulse to represent the state of the apparatus. In some cases, the representation of the state of the apparatus may correspond to an audible chime, churp, beep, or the like, and a speaker may emit the audible noise to indicate the state of the apparatus. In some cases, multiple electronic components may be used to indicate state information. For example, a display panel and a front sight may emit a color to indicate gun state information.

Figure 11:
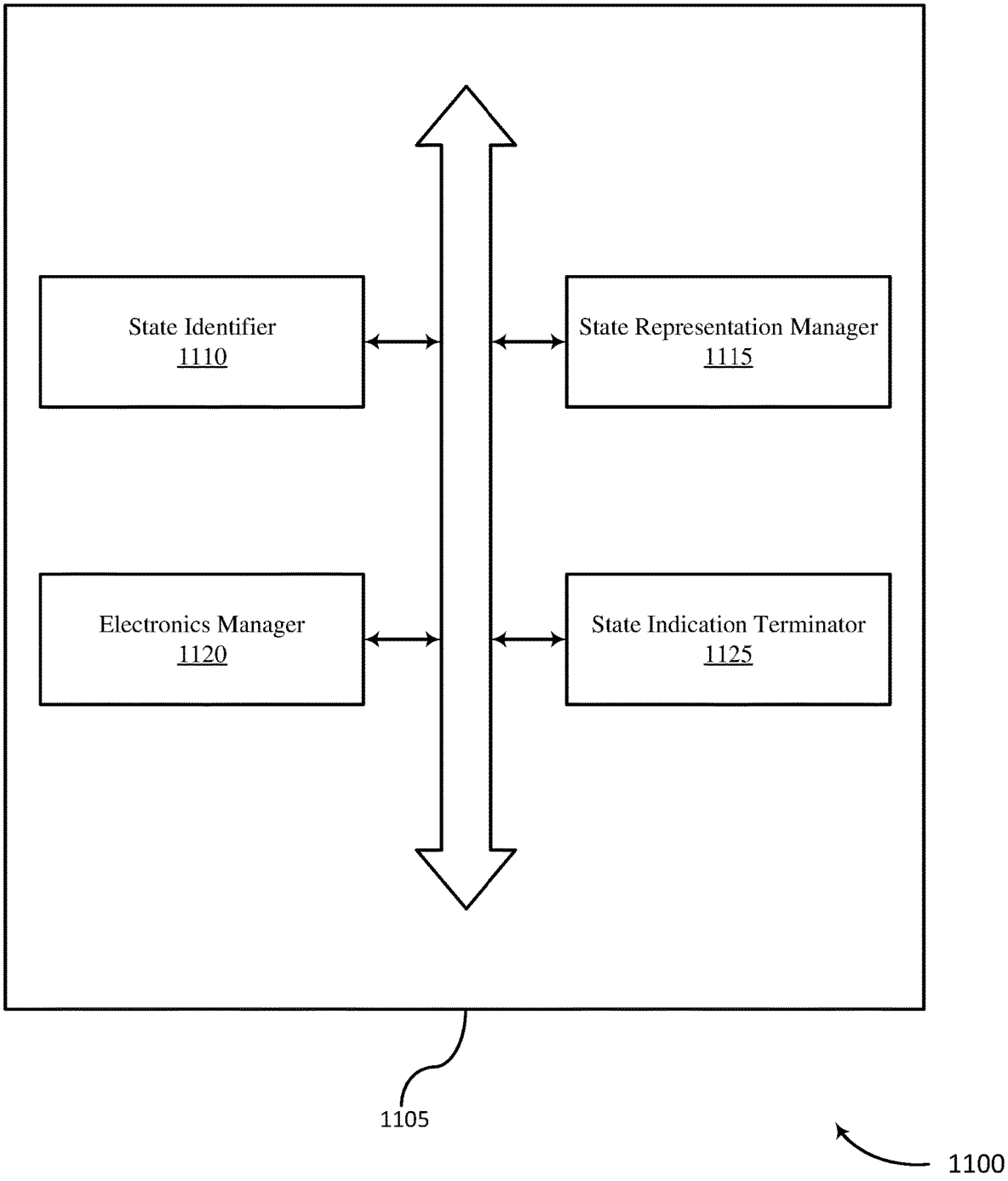
FIG. 11 illustrates an example of a block diagram that supports indicating gun state information in accordance with aspects of the present disclosure.

FIG. 11 illustrates an example of a block diagram 1100 that supports indicating gun state information in accordance with aspects of the present disclosure. The state indication manager 1105 may include a state identifier 1110, a state representation manager 1115, an electronics manager 1120, and a state indication terminator 1125. Each of these components may communicate, directly or indirectly, with one another (e.g., via one or more buses).

The state identifier 1110 may identify, based on a compute component comprising a data signal, a state of the apparatus (e.g., a gun). The compute component may be coupled with the apparatus. In some cases, a component, such as a user presence sensor or a biometric sensor, may transmit the data signal to the compute component, while in some other cases, the compute component may store the data signal (e.g., store the data signal in volatile memory or non-volatile memory). The state representation manager 1115 may select a representation of the state of the apparatus, where the representation of the state of the apparatus is compatible with an electronic component coupled with the apparatus.

The electronics manager 1120 may indicate, at the electronic component and based on the compute component, the state of the apparatus with the representation of the state of the apparatus. The electronics manager 1120 may illuminate the electronic component with a color, where the representation of the state of the apparatus comprises the color. The electronics manager 1120 may display an icon with the electronic component, where the representation of the state of the apparatus comprises the icon.

The state indication terminator 1125 may terminate the indication of the state of the apparatus. Terminating the indication of the state of the apparatus may be based on a user releasing the gun, expiration of a timer, an apparatus battery power level satisfying a threshold, removal of a magazine from the apparatus, or firing a projectile from the apparatus.

Terminating the indication of the state of the gun may include modifying a color of the electronic component, altering a pulse pattern of the electronic component, removing an icon from a display panel, or powering down the electronic component.

The electronic component may include an aiming sight of the apparatus and/or a display panel. The electronic component may be located on a rearward portion of the apparatus, above a gun grip.

The representation of the state of the apparatus may include a color, a light pulse pattern, an icon, a haptic pulse pattern, an audible noise, or a temperature.

The electronics manager 1120 may modify the representation of the state of the apparatus, where modifying the representation of the state of the apparatus includes modifying a color, a light pulse pattern, an icon, a haptic pulse pattern, an audible noise, or a temperature, or where modifying the representation of the state of the apparatus includes modifying a state indication timeout length.

The electronics manager 1120 may enable error reporting, where the error reporting includes displaying an error message as text on the electronic component.

The state of the apparatus may correspond to a ready state, a locked state, an unlocked state, an error state, a charging state, a battery power state, a magazine present state, a magazine not present state, a round chambered state, or a round not chambered state.

The apparatus may include a gun. For example, the apparatus may correspond to an electromechanical gun.

Figure 12:
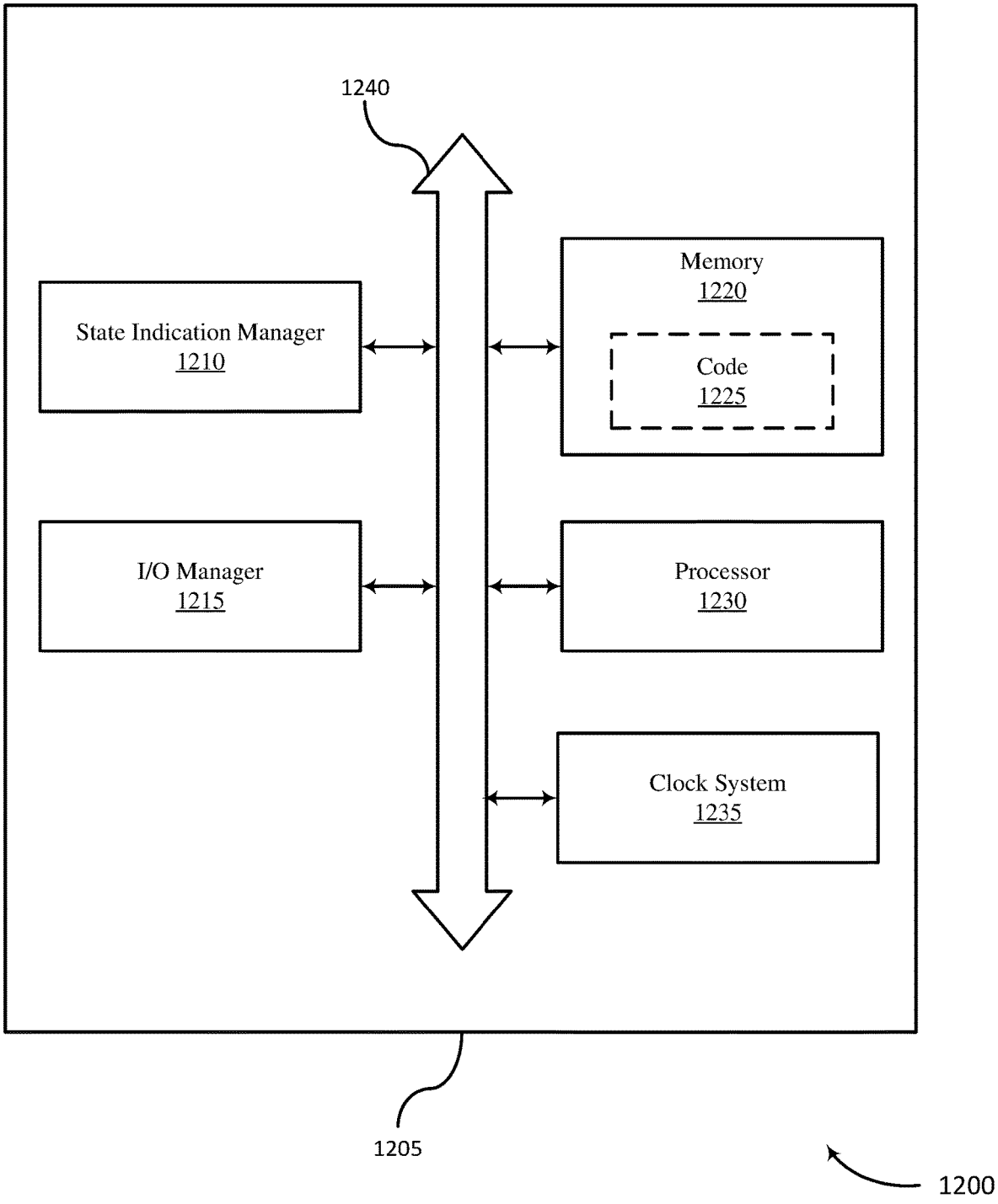
FIG. 12 illustrates an example of a system that supports indicating gun state information in accordance with aspects of the present disclosure.

FIG. 12 illustrates an example of a system 1200 that supports indicating gun state information in accordance with aspects of the present disclosure. The device 1205 may be operable to implement the techniques, technology, or systems disclosed herein. The device 1205 may include components such as a state indication manager 1210, an I/O manager 1215, memory 1220, code 1225, a processor 1230, a clock system 1235, and a bus 1240. The components of the device 1205 may communicate via one or more buses 1240. The device 1205 may be an example of, or include components of, a firearm, a firearm safety system, a system for indicating gun state information, or a state indication manager 1105 as described herein.

The state indication manager 1210 may identify, based on a compute component including a data signal, a state of an apparatus, where the compute component is coupled with the apparatus, select a representation of the state of the apparatus, where the representation of the state of the apparatus is compatible with an electronic component coupled with the apparatus, and indicate, at the electronic component and based on the compute component, the state of the apparatus with the representation of the state of the apparatus.

The I/O manager 1215 may manage input and output signals for the device 1205. The I/O manager 1215 may also manage various peripherals such an input device (e.g., a button, a switch, a touch screen, a dock, a biometric sensor, a pressure sensor, a heat sensor, a proximity sensor, an RFID sensor, etc.) and an output device (e.g., a monitor, a display, an LED, a speaker, a haptic motor, a heat pipe, etc.).

The memory 1220 may include or store code (e.g., software) 1225. The memory 1220 may include volatile memory, such as random-access memory (RAM) and/or non-volatile memory, such as read-only memory (ROM). The code 1225 may be computer-readable and computer-executable, and when executed, the code 1225 may cause the processor 1230 to perform various operations or functions described here.

The processor 1230 may be an example or component of a central processing unit (CPU), an application specific integrated circuit (ASIC), or a field programmable gate array (FPGA). In some embodiments, the processor 1230 may utilize an operating system or software such as Microsoft Windows®, iOS®, Android®, Linux®, Unix®, or the like. The clock system 1235 control a timer for use by the disclosed embodiments.

The state indication manager 1210, or its sub-components, may be implemented in hardware, software (e.g., software or firmware) executed by a processor, or a combination thereof. The state indication manager 1210, or its sub-components, may be physically located in various positions. For example, in some cases, the state indication manager 1210, or its sub-components may be distributed such that portions of functions are implemented at different physical locations by one or more physical components.

It should be noted that the methods described herein illustrate possible implementations, and method steps or operations may be rearranged, removed, supplemented, otherwise modified. Further, aspects from two or more of the methods may be combined. Data and signals described herein may be represented using a variety of different technologies and techniques. For example, information, messages, instructions, commands, bits, symbols, data, and signals that may be referenced throughout the description may be represented by any combination of voltages, currents, electromagnetic waves, magnetic fields or particles, optical fields or particles.

In some cases, the terms "coupled," "connected," and "electronic communications" may refer to a relationship between components that supports the flow of signals between components. For example, a first component is considered to be coupled with a second component (or connected to the second component or in electronic communication with the second component) when there is a conductive path between the first component and the second component. The conductive path may be a direct path between the components, or the conductive path may be an indirect path between the components, which may include transistors, switches, or other components. In some other cases, the terms "coupled" and "connected" may refer to a relationship between components, where the components are fastened, joined, attached, tethered, bonded, or otherwise linked. The components may be coupled or connected such that the components are static with respect to each other, or the components may be coupled such that the components are displaced, or configured for displacement, in one or more directions. For example, an aiming sight may be coupled with a slide (e.g., via snap-fit joints, screws, adhesive, pins, etc.) such that the sight and slide are static with respect to each other, and the slide may be coupled with a frame (e.g., via a rail system) such that the slide may travel along a longitudinal axis.

Some of the components described herein, such as memory, may be formed on a semiconductor substrate, such as silicon, germanium, silicon-germanium allow, gallium arsenide, etc. In some cases, the substrate may be a semiconductor wafer, while in some other cases, the substrate may be a silicon-on-insulator substrate, such as silicon-on-sapphire. The memory may store and provide access to information, data, code, instructions, or data structures.

The functions, techniques, components, and illustrative blocks described herein may be implemented or performed with a general-purpose processor, a specific-purpose processor, a digital signal processor (DSP), a central processing unit (CPU), a graphics processing unit (GPU), a tensor processing unit (TPU), a neural processing unit (NPU), an image signal processor (ISP), a hardware security module (HSM), an application-specific integrated circuit (ASIC), a programmable logic device, such as a field-programmable gate array (FPGA), discrete hardware components, or any combination thereof designed to perform the functions described herein. In some cases, a general-purpose processor may be a microprocessor, while in some other cases, the general-purpose processor may be any processor, controller, microcontroller, or state machine. A processor may also be implemented as a combination of computing devices, such as a one or more microprocessors and one or more DSPs.

The functions described herein may be implemented in hardware and/or software (e.g., firmware) executed by a processor. If implemented in software executed by a processor, the functions may be stored on or transmitted over as instructions or code on a computer-readable medium. Features or components implementing functions may also be physically located at various locations, and different functions or portions of functions may be implemented at different physical locations.

Computer-readable media includes both non-transitory computer storage media and communication media. A non-transitory storage medium may be any available medium that may be accessed by a computer or component. For example, non-transitory computer-readable media may include random-access memory (RAM), static RAM (SRAM), dynamic RAM (DRAM), read-only memory (ROM), electrically erasable programmable ROM (EEPROM), flash memory, magnetic storage devices, or any other non-transitory medium that may be used to carry and/or store program code means in the form of instructions and/or data structures. The instructions and/or data structures may be accessed by a general-purpose computer, a special-purpose computer, a general-purpose processor, a special-purpose processor, or a hardware component. A computer-readable media may include any combination of the above, and a compute component may include computer-readable media.

In the figures, similar components or features may have the same reference label, and components of the same or similar type may be distinguished by appending a dash and a second label (e.g., 105-*a* and 105-*b*) to the reference label. If just the first reference label is used in the specification, the description is applicable to any one of the similar components having the same first reference label regardless of the second label.

The description provided herein, in connection with the appended figures (or drawings), describes example configurations and does not represent all the examples that may be implemented or that are within the scope of the claims. The term "example" used herein means "serving as an illustration or instance," and not "a preferred example." The description includes specific details to provide an understanding of the described techniques, but the techniques may be practiced without these specific details.

As used herein, when used in a list of items, the term "or" indicates a list of the items including at least one of the items in the list. For example, the list "A, B, or C" indicates the list "A" or "B" or "C" or "A and B" or "A and C" or "B and C" or "A and B and C." As used herein, the phrase "based on" does not imply a closed set of conditions. For example, the phrase "A is based on B" does not imply that "A" is based solely on "B."

The description herein enables a person having ordinary skill in the art to use or make use of the disclosure. The description describes example designs, implementations, and configurations, and does not represent all the examples that may be implemented or that are within the scope of the claims.

An apparatus in described, and the apparatus may be in the form of a gun. The apparatus may include a processor, memory coupled with the processor, and instructions stored in the memory and executable by the processor to cause the apparatus to receive, at the processor and based on one or more user presence sensors, a data signal indicating a user presence, where the user presence corresponds to a user holding the apparatus, perform, based at least in part on the data signal indicating the user presence, a user authentication procedure, where, as a result of the user authentication procedure, the user holding the apparatus is authorized to operate the apparatus, identify, based at least in part on the data signal and the user authentication procedure, an unlocked state of the apparatus, where the unlocked state permits the user to fire a projectile from the apparatus, select, based at least in part on identifying the unlocked state of the apparatus, a color representing the unlocked state of the apparatus, where a front sight of the apparatus is capable of illuminating with the color, and illuminate the front sight of the apparatus with the color representing the unlocked state of the apparatus.

Another apparatus is described, and the apparatus may be in the form of a gun. The apparatus may include means for receiving, based on one or more user presence sensors, a data signal indicating a user presence, where the user presence corresponds to a user holding the apparatus, performing, based at least in part on the data signal indicating the user presence, a user authentication procedure, where, as a result of the user authentication procedure, the user holding the apparatus is authorized to operate the apparatus, identifying, based at least in part on the data signal and the user authentication procedure, an unlocked state of the apparatus, where the unlocked state permits the user to fire a projectile from the apparatus, selecting, based at least in part on identifying the unlocked state of the apparatus, a color representing the unlocked state of the apparatus, where a front sight of the apparatus is capable of illuminating with the color, and illuminating the front sight of the apparatus with the color representing the unlocked state of the apparatus.

A non-transitory computer readable medium storing code is described, and the non-transitory computer readable medium storing code may be at a gun. The code may include instructions executable by a process to receive, based on one or more user presence sensors, a data signal indicating a user presence, where the user presence corresponds to a user holding the gun, perform, based at least in part on the data signal indicating the user presence, a user authentication procedure, where, as a result of the user authentication procedure, the user holding the gun is authorized to operate the gun, identify, based at least in part on the data signal and the user authentication procedure, an unlocked state of the gun, where the unlocked state permits the user to fire a projectile from the gun, select, based at least in part on identifying the unlocked state of the gun, a color representing the unlocked state of the gun, where a front sight of the gun is capable of illuminating with the color, and illuminate the front sight of the gun with the color representing the unlocked state of the gun.

A method is described, and the method may be performed at a gun. The method may be performed at a device such as a lethal gun, a less-lethal gun, or a stun-gun (e.g. a Taser®). The method may include receiving, based on one or more user presence sensors, a data signal indicating a user presence, where the user presence corresponds to a user holding the gun, performing, based at least in part on the data signal indicating the user presence, a user authentication procedure, where, as a result of the user authentication procedure, the user holding the gun is authorized to operate fire the gun, identifying, based at least in part on the data signal and the user authentication procedure, an unlocked state of the gun, where the unlocked state permits the user to fire a projectile from the gun, selecting, based at least in part on identifying the unlocked state of the gun, a color representing the unlocked state of the gun, where a front sight of the gun is capable of illuminating with the color, and illuminating the front sight of the gun with the color representing the unlocked state of the gun An apparatus in described, and the apparatus may be in the form of a gun. The apparatus may include a processor, memory coupled with the processor, and instructions stored in the memory and executable by the processor to cause the apparatus to identify, based on a compute component including a data signal, a state of the apparatus, where the compute component is coupled with the apparatus, select a representation of the state of the apparatus, where the representation of the state of the apparatus is compatible with an electronic component coupled with the apparatus, and indicate, at the electronic component and based on the compute component, the state of the gun with the representation of the state of the apparatus.

Another apparatus is described, and the apparatus may be in the form of a gun. The apparatus may include means for identifying, based on a compute component including a data signal, a state of the apparatus, where the compute component is coupled with the apparatus, selecting a representation of the state of the apparatus, where the representation of the state of the apparatus is compatible with an electronic component coupled with the apparatus, and indicating, at the electronic component and based on the compute component, the state of the apparatus with the representation of the state of the apparatus.

A non-transitory computer readable medium storing code is described, and the non-transitory computer readable medium storing code may be at a gun. The code may include instructions executable by a process to identify, based on a compute component including a data signal, a state of the apparatus, where the compute component is coupled with the apparatus, select a representation of the state of the apparatus, where the representation of the state of the apparatus is compatible with an electronic component coupled with the apparatus, and indicate, at the electronic component and based on the compute component, the state of the apparatus with the representation of the state of the apparatus.

A method is described, and the method may be performed at a gun. The method may be performed at a device such as a lethal gun, a less-lethal gun, or a taser. The method may include identifying, based on a compute component including a data signal, a state of the gun, where the compute component is coupled with the gun, selecting a representation of the state of the gun, where the representation of the state of the gun is compatible with an electronic component coupled with the gun, and indicating, at the electronic component and based on the compute component, the state of the gun with the representation of the state of the gun.

Some examples of the method, apparatuses, and non-transitory computer-readable medium described herein may include components, features, instructions, code, operations, or means for illuminating the electronic component with a color, where the representation of the state of the apparatus comprises the color.

Some examples of the method, apparatuses, and non-transitory computer-readable medium described herein may include components, features, instructions, code, operations, or means for displaying an icon with the electronic component, where the representation of the state of the apparatus comprises the icon.

Some examples of the method, apparatuses, and non-transitory computer-readable medium described herein may include components, features, instructions, code, operations, or means for terminating the indication of the state of the apparatus.

In some examples of the method, apparatuses, and non-transitory computer-readable medium described herein, terminating the indication of the state of the apparatus is based at least in part on a user releasing the apparatus, expiration of a timer, an apparatus battery power level satisfying a threshold, removal of a magazine from the apparatus, or firing a projectile from the apparatus.

In some examples of the method, apparatuses, and non-transitory computer-readable medium described herein, terminating the indication of the state of the apparatus comprises modifying a color of the electronic component, altering a pulse pattern of the electronic component, removing an icon from a display panel, or powering down the electronic component.

In some examples of the method, apparatuses, and non-transitory computer-readable medium described herein, the electronic component comprises an aiming sight of the apparatus. The electronic component may include an LED, and the LED may be used as a front aiming sight for the apparatus.

In some examples of the method, apparatuses, and non-transitory computer-readable medium described herein, the electronic component comprises an aiming sight of the firearm. In some examples of the method, apparatuses, and non-transitory computer-readable medium described herein, the electronic component comprises a display panel. In some examples of the method, apparatuses, and non-transitory computer-readable medium described herein, the electronic component is located on a rearward portion of the apparatus, above a gun grip.

In some examples of the method, apparatuses, and non-transitory computer-readable medium described herein, the representation of the state of the apparatus comprises a color, a light pulse pattern, an icon, a haptic pulse pattern, an audible noise, or a temperature.

Some examples of the method, apparatuses, and non-transitory computer-readable medium described herein may include components, features, instructions, code, operations, or means for modifying the representation of the state of the apparatus, where modifying the representation of the state of the apparatus comprises modifying a color, a light pulse pattern, an icon, a haptic pulse pattern, an audible noise, or a temperature, or where modifying the representation of the state of the apparatus comprises modifying a state indication timeout length. In some cases, the color may be based at least in part on a user input. For example, a user may press a tactile button or a virtual button on a display panel to provide user input, and the color may be modified based on the provided user input.

Some examples of the method, apparatuses, and non-transitory computer-readable medium described herein may include components, features, instructions, code, operations, or means for enabling error reporting, where the error reporting comprises displaying an error message as text on the electronic component.

In some examples of the method, apparatuses, and non-transitory computer-readable medium described herein, the state of the apparatus corresponds to a ready state, a locked state, an unlocked state, an error state, a charging state, a battery power state, a magazine present state, a magazine not present state, a round chambered state, or a round not chambered state. The apparatus may include or otherwise correspond to a gun. For example, the apparatus may correspond to an electromechanical gun. In some cases, apparatus may correspond to a pistol, a rifle, or a shotgun.

What is claimed is:

1. A method of indicating information about a gun, the method comprising:

generating, by a presence sensor of the gun, an electrical signal indicating activation of the presence sensor;

determining, in response to the generating the electrical signal, that a user is holding the gun;

identifying a search state based on the determining that the user is holding the gun, wherein the search state corresponds to the gun searching for a data match to authenticate the user as an authorized user; and illuminating an electronic component of the gun to visually indicate that the gun has entered the search state.

2. The method of claim 1, further comprising:

powering on, in response to the determining that the user is holding the gun, an additional electronic component of the gun.

3. The method of claim 2, wherein the additional electronic component comprises a central processing unit, a graphics processing unit, or an integrated circuit.

4. The method of claim 1, wherein the determining that the user is holding the gun comprises:

measuring a voltage of the electrical signal generated by the presence sensor; and determining that the voltage satisfies a threshold voltage.

5. The method of claim 4, wherein the voltage indicates (i) an amount of force applied to a grip of the gun or (ii) an amount of displacement of the grip of the gun.

6. The method of claim 1, further comprising:

terminating the illumination of the electronic component.

7. The method of claim 6, further comprising:

determining, by a compute component of the gun, that the user is no longer holding the gun, wherein the terminating the illumination of the electronic component is in response to the determining that the user is no longer holding the gun.

8. The method of claim 6, further comprising:

measuring a voltage generated by the presence sensor; and determining, based on the voltage, that the user is not holding the gun;

wherein the terminating the illumination of the electronic component is in response to the determining that the user is not holding the gun.

9. The method of claim 1, wherein a data match is based on a similarity measurement satisfying a similarity threshold, wherein the similarity measurement indicates an amount of similarity between query authentication data collected by the gun and enrollment authentication data stored on the gun.

10. The method of claim 1, wherein the electronic component comprises an aiming sight.

11. The method of claim 1 wherein the electronic component comprises a light pipe located below a slide on a rear section of the gun.

12. A method performed by a processor included in a gun, the method comprising:

determining, based on real-time analysis of a signal output by a presence sensor, that an individual is presently holding the gun; and causing a component of the gun to be illuminated to visually indicate that the gun has entered a search state in which a search is completed for data to authenticate the individual as an authorized user.

13. The method of claim 12, further comprising:

determining, based on real-time analysis of an additional signal output by the presence sensor, that the individual is not presently holding the gun; and causing the component of the gun to terminate illumination to visually indicate that the gun has exited the search state.

14. A gun comprising:

a presence sensor configured to generate an electrical signal to indicate activation of the presence sensor;

a compute component that is electronically coupled with the presence sensor, wherein the compute component is configured to:

determine that a user is holding the gun based on the electrical signal, and identify a search state in response to the determining that the user is holding the gun; and an electronic component that is electronically coupled with the compute component, wherein the electronic component is configured to generate, in response to the compute component determining that the user is holding the gun, a human perceivable indication that the gun is in the search state.

15. The gun of claim 14, wherein the electronic component comprises:

a light pipe configured to illuminate so as to visually indicate that the gun is in the search state.

16. The gun of claim 15, wherein the light pipe is an aiming sight of the gun.

17. The gun of claim 15, wherein the light pipe is located on a rear section of the gun, below a slide when the gun is in an upright orientation.

18. The gun of claim 14, wherein the electronic component comprises:

a haptic motor configured to pulse so as to tactilely indicate that the gun is in the search state.

19. The gun of claim 18, wherein the haptic motor is embedded in a grip portion of the gun.

20. A gun comprising:

a presence sensor configured to generate an electrical signal to indicate activation of the presence sensor;

means for determining a state of the gun, wherein the means for determining the state of the gun is electronically coupled with the presence sensor, and wherein the means for determining the state of the gun is configured to determine, based on the electrical signal generated by the presence sensor, that the gun is in a search state and indicate, to an electronic component, that the gun is in the search state; and the electronic component that is electronically coupled with the means for determining the state of the gun, wherein the electronic component is configured to generate, based on the indication that the gun is in the search state, a visual indication of the search state.

21. The gun of claim 20, wherein the means for determining the state of the gun is configured to determine that the gun is in the search state based on a voltage of the electrical signal being greater than a threshold voltage.

22. The gun of claim 20, wherein the means for determining the state of the gun is configured to cause the electronic component to generate the visual indication of the search state.

* * * * *